US006051118A

United States Patent [19]

Asaki et al.

[11] Patent Number: 6,051,118

[45] Date of Patent: Apr. 18, 2000

[54] COMPOUND ELECTRODE FOR ELECTROLYSIS

[75] Inventors: Tomoyoshi Asaki; Yukio Arai; Toshimi Mori, all of Soka; Teruki Takayasu, Ikoma, all of Japan

[73] Assignees: Ishifuku Metal Industry Co., Ltd., Tokyo; Showa Co., Ltd., Ikoma, both of Japan

[21] Appl. No.: 09/142,662

[22] PCT Filed: Mar. 14, 1996

[86] PCT No.: PCT/JP96/00633

§ 371 Date: Sep. 14, 1998

§ 102(e) Date: Sep. 14, 1998

[87] PCT Pub. No.: WO97/34029

PCT Pub. Date: Sep. 18, 1997

[51] Int. Cl.[7] ..... C25B 11/00

[52] U.S. Cl. ..... 204/280; 204/286; 204/290 F; 204/206; 204/213

[58] Field of Search ..... 204/280, 286, 204/290 F, 281, 206, 213

[56] References Cited

U.S. PATENT DOCUMENTS

| | | | |
|---|---|---|---|
| 5,017,275 | 5/1991 | Niksa et al. | 204/206 |
| 5,135,633 | 8/1992 | Katowski et al. | 204/286 |
| 5,344,538 | 9/1994 | Chamberlain et al. | 204/290 R |
| 5,626,730 | 5/1997 | Shimamuna et al. | 204/280 |
| 5,628,892 | 5/1997 | Kawashima et al. | 204/280 |
| 5,733,424 | 3/1998 | Dehm et al. | 204/286 |
| 5,783,058 | 7/1998 | Fowler et al. | 204/290 R |

FOREIGN PATENT DOCUMENTS

| | | |
|---|---|---|
| 0 504 939 | 9/1992 | European Pat. Off. . |
| 1-176100 | 7/1989 | Japan . |
| 3-42043 | 9/1991 | Japan . |
| 5-230686 | 9/1993 | Japan . |
| 6-47758 | 6/1994 | Japan . |
| 6-346270 | 12/1994 | Japan . |

*Primary Examiner*—Bruce F. Bell
*Attorney, Agent, or Firm*—Wenderoth, Lind & Ponack, L.L.P.

[57] ABSTRACT

An electrolytic composite electrode provided with a cathode formed from a drum to be rotated and an anode having a circular-arc inner surface facing the cathode at a certain interval and capable of keeping an electrolytic solution between the anode and the cathode. The anode comprises a first electrode substrate at least whose portion contacting the electrolytic solution is made of a corrosion-resistant metal and which has a plurality of female screw portions provided along a line parallel with the rotation axis of the drum, a second electrode substrate whose one side is covered with an electrode catalyst and which is formed with a titanium tie plate divided on a plurality of parting faces parallel with the rotation axis of the drum and has a plurality of holes formed on the center axis parallel with the parting faces, a bolt screwed to the female screw portion of the first electrode substrate to secure the second electrode substrate to the first electrode substrate, a first intermediate member provided for the circumferential portion of the bolt between the first electrode substrate and the second electrode substrate, and a second intermediate member provided for the vicinity of the circumference of the second electrode substrate between the first electrode substrate and the second electrode substrate.

6 Claims, 5 Drawing Sheets

COMPOUND ELECTRODE FOR ELECTROLYSIS

TECHNICAL FIELD

The present invention relates to an electrolytic composite electrode provided with an electrolytic insoluble anode used for tinning or galvanizing a steel plate requiring a large current, or manufacturing a copper foil by the electroplating method.

BACKGROUND ART

In recent years, a plating current has increased as a plating rate has increased in the electroplating field. A high plating current density of 30 to 250 A/dm$^2$ is used for galvanizing or tinning a steel plate or manufacturing a metallic foil by the electroplating method. Moreover, it is requested to plate a banded material having a large width of 500 to 2,000 mm or obtain a metallic foil through electroplating. Therefore, to plate the large material, it is unavoidable that an insoluble electrode to be used increases in size. Moreover, in the case of manufacturing plated products or metallic foils, it is requested to further improve the quality of these products and keep the fluctuation of the inter-electrode distance between an anode and a cathode at 5% or less.

Therefore, it is attempted to use a composite electrode substrate obtained by using a conductive material such as copper, iron, aluminum, lead, or tin as a core and covering the core with a titanium plate for a large insoluble electrode to be operated at the above large current from the viewpoints of conductivity and profitability.

However, the above large composite electrode substrate has a considerably large weight and it is difficult to handle it when machining it. Moreover, the following problems occur when covering an electrode catalyst.

(a) A large heavy electrode substrate has a large heat capacity. Particularly, in the case of an insoluble anode manufactured by repeating heat treatment at a high temperature of 350 to 700° C. and thereby covering an electrode catalyst such as a platinum-group metal or its oxide, the energy loss under heat treatment increases and moreover, it takes a lot of time to raise or lower the temperature.

(b) In the case of a composite electrode substrate, when covering an electrode catalyst, a joint between different types of metals is easily distorted or damaged.

(c) To cover an electrode catalyst, precision machining of the several-micron order is requested. Therefore, a considerably-high equipment cost is required to machine a large electrode substrate.

The official gazette of Japanese Utility Model Publication No. Hei 3-42043 discloses a device for solving the above problem. According to the device, it is possible to set or remove a second electrode substrate by using a composite electrode substrate as a first electrode substrate and supporting the second electrode made of a titanium plate covered with an electrode catalyst manufactured separately from the first electrode substrate to the first electrode substrate with a bolt.

Moreover, the official gazette of Japanese Patent Publication No. Hei 6-47758 discloses an art for deflecting a removable anode tie plate (second electrode substrate) by supporting the anode tie plate with a circular-arc electrolytic cell (first electrode substrate) having support means for supporting the anode tie plate in a circular-arc insoluble anode.

However, when an electrode becomes circular-arc, it is difficult to finish the first electrode substrate into a high-accuracy circular arc by the arts disclosed in the official gazettes of Japanese Utility Model Publication No. Hei 3-42043 and Japanese Patent Publication No. Hei 6-47758, differently from the case in which the first electrode substrate uses a plate. Therefore, it is difficult to decrease the fluctuation of the inter-electrode distance between an anode and a cathode even if supporting the second electrode substrate with the first electrode substrate. Moreover, a circular-arc electrode has a problem that fluctuation occurs in inter-electrode distances due to a slight deviation from the rotation axis of a cathode drum to be rotated.

To solve the problems, the official gazette of Japanese Patent Publication No. Hei 6-47758 further discloses an adjustment mechanism for keeping the gap between a cathode and an insoluble electrode constant. However, there are the following problems because adjustment is performed from the outside of an electrolytic cell (first electrode substrate).

Firstly, it is necessary to prevent support means for supporting an anode tie plate (second electrode substrate) with an electrolytic cell (first electrode substrate) from being wetted by liquid. Moreover, to use a mechanism for adjusting an anode tie plate (second electrode substrate), the structure becomes more complex.

Secondly, in the case of supporting an insoluble electrode to an electrolytic cell (first electrode substrate) by deflecting the electrode, a stress is applied to the covered layer of an electrode catalyst due to deflection. Therefore, when the electrode catalyst layer is used in a high-current-density region, it is deteriorated.

Thirdly, in the case of adjusting an insoluble electrode surface facing a cathode separately from the rotation axis of a cathode drum, it is necessary to adjust the position of the insoluble electrode surface at both the composite electrode substrate side and the insoluble electrode side. Therefore, the adjustment requires much time, or fine adjustment is difficult.

Fourthly, because adjustment is performed from the outside of an electrolytic cell (first electrode substrate), a large space is necessary.

DISCLOSURE OF THE INVENTION

To solve the above problems, the present invention provides an electrolytic composite electrode provided with a cathode formed from a rotated drum and an anode having a circular-arc inner surface facing the cathode at a constant interval; wherein the anode is provided with;

- a first electrode substrate at least whose portion contacting with an electrolytic solution is made of a corrosion-resistant metal and which has a plurality of female screw portions provided along a line parallel with the rotation axis of the drum and a second electrode substrate formed with a titanium tie plate divided on a plurality of parting faces parallel with the rotation axis of the drum and having a plurality of holes formed on the center axis parallel with the parting faces,
- a bolt extending through the hole of the second electrode substrate and screwed to the female screw portion of the first electrode substrate to secure the second electrode substrate to the first electrode substrate,
- a first intermediate member provided around the bolt between the first electrode substrate and the second electrode substrate, and
- a second intermediate member provided around the second electrode substrate between the first electrode substrate and the second electrode substrate.

The thickness of the first electrode substrate is determined by the electrical resistance and current of a material used. The accuracy of the curve of the first electrode substrate is enough when it is kept within ±2 mm of a predetermined length from the rotation axis of the cathode drum. The corrosion-resistant metal provided for the portion contacting with the electrolytic solution requires a thickness of 0.5 mm or more in order to prevent the core from being corroded due to contact with a plating solution. However, the female screw portion for securing the second electrode substrate with a bolt requires a depth up to the core having no corrosion resistance when the corrosion-resistant plate has a small thickness. Therefore, it is necessary to prevent the plating solution from entering the female screw hole by a method for embedding a corrosion-resistant metal into the hole or by filling the hole with sealing resin when securing the second electrode substrate with the bolt. Moreover, it is possible to form a female screw portion only on the corrosion-resistant metal.

Thus, the first electrode substrate can have a structure covered with a corrosion-resistant metal or a structure made of a pure corrosion-resistant metal. The corrosion-resistant metal can use titanium, tantalum, niobium, zirconium, or an alloy mainly containing these metals.

It is possible to design the thickness of the second electrode substrate in a range of 2 to 20 mm, preferably 5 to 15 mm. It is most preferable to machine the second electrode substrate before setting it to the first electrode substrate into a curved shape at a radius-of-curvature machining accuracy equal to that of a predetermined radius (500 to 2,000 mm) when setting the second electrode substrate to the first electrode substrate. However, the above machining is impossible in fact. Therefore, it is preferable to keep the accuracy of the radius of curvature of the second electrode substrate at +300% or less and it is more preferable to keep it at +200% or less. When the curvature is larger than the above value, a stress produced due to setting of the second electrode substrate to the first electrode substrate is applied to the first electrode substrate and thereby, a problem occurs that the first electrode substrate is deformed and the accuracy is deteriorated or the electrode catalyst layer covering the second electrode substrate is deflected and thereby, it may be deteriorated. Moreover, when the machining accuracy takes a minus value to a predetermined radius, a problem occurs that the height of the second electrode substrate cannot be completely adjusted. In the case of division in the direction parallel with the rotation axis of the cathode drum of the second electrode substrate, it is suitable from the view points of the accuracy and the setting and adjustment to set the divided length to 200 to 500 mm, preferably to 250 to 400 mm. Moreover, it is preferable to optionally divide the second electrode substrate in the rotational direction of the cathode. It is preferable to design the way of dividing the second electrode substrate so that the number of bolt holes formed on one of the divided second electrode substrates is 2 or more, preferably 2 or 3. This is because, by setting a mechanism for adjusting the height of the second electrode substrate using an intermediate member, a slight distortion not influencing the interval accuracy between a cathode and an anode produced due to height adjustment can be removed by optionally dividing the second electrode substrate in the rotational direction of the cathode and assembling becomes easy. Moreover, to divide a second electrode substrate in the rotational direction of the cathode, it is necessary to divide and arrange the second electrode substrate so that parting lines of other arranged second electrode substrates do not become a straight line. For example, it is necessary to arrange second electrode substrates so that the parting line of the second electrode substrate extending in the rotational direction of a cathode drum and those of other second electrode substrates extending in the rotational direction of the cathode drum do not become a straight line.

Furthermore, by closing the bolt hole of the second electrode substrate for securing the second electrode substrate to the first electrode substrate by a third electrode substrate whose one side is covered with electrode catalyst so that the electrode catalyst surface of the second electrode substrate and that of the third electrode substrate become the same surface and current can be applied to the third electrode substrate, unevenness of the current distribution of the hole portion of the second electrode substrate can be settled. To secure the third electrode substrate or apply current to the third electrode substrate, it is possible to use a method of securing the third electrode substrate to the second electrode substrate or the bolt head for securing the second electrode substrate by using a flat countersunk head screw made of titanium having a diameter of 1 to 5 mm. Moreover, a method of fitting the third electrode substrate to the bolt head is also effective.

The first intermediate member used around the hole can use titanium, tantalum, niobium, zirconium, or an alloy mainly containing them. It is preferable cover the surface of the first intermediate member contacting with the first electrode substrate and second electrode substrate or the surfaces of intermediate members contacting with each other with platinum of submicrons to several microns in order to decrease the contact resistance. The first intermediate member can use any thickness. Substantially, however, a thickness of 0.05 to 30 mm is used. When the first intermediate member is a thick flat plate which is not deflected by being fastened by a bolt, it is necessary to flatten the surfaces of the first and second electrode substrates at a portion contacting with the first intermediate member so as to face in parallel with each other from the viewpoint of current supply. It is possible to freely select the shape of the first intermediate member out of a flat plate, curved plate, and irregular plate by considering the contact resistance with an electrode substrate. Moreover, the second intermediate member provided nearby the circumference of the second electrode substrate is not restricted in quality as long as it can be adjusted in height and it has a corrosion resistance and a shape and strength capable of supporting the second electrode substrate. It is possible to set the first and second intermediate members to both or either of the first and second electrode substrates by welding, screwing, or caulking. Furthermore, though the number of first and second intermediate members to be arranged depends on the accuracy to be required, it is 30 to 300/$m^2$, preferably 60 to 210/$m^2$. When the number of first and second intermediate members to be arranged is 60/$m^2$ or less, particularly less than 30/$m^2$ , it is impossible to obtain a desired accuracy. Moreover, when the number of first and second intermediate members to be arranged is 210/$m^2$ or more, particularly 300/$m^2$ or more, it takes much time to set them and therefore, technical effect is not obtained very much though economic load increases. It is preferable to set the ratio between the number of first intermediate members and the number of second intermediate members to 1:2 to 1:10. It is preferable to arrange second intermediate members at least nearby the circumference of the second electrode substrate so that one first intermediate member and two second intermediate members draw an isosceles triangle using the first intermediate member as its vertex or an equilateral triangle. Therefore, the ratio between the number of first intermediate members and the number of second intermediate members becomes at least 1:2. Moreover, when the number of second intermediate members is too many compared with the number of first intermediate members, technical effect is not obtained very much though economic load increases. Furthermore, by additionally arranging third intermediate members (not illustrated) so that they are respectively located at the middle of the sides of these triangles, it is possible to make adjustment at higher accuracy. The third intermediate member can be also set to the both or either of the first and second electrode substrates as described above. However, it is unnecessary to insert the first, second, and third intermediate members into portions having a predetermined accuracy.

To measure the height of the second electrode substrate, there are a method of measuring the gap between a regular-size measuring rod set to the rotation axis of a cathode drum and rotating about the rotation axis and the second electrode substrate and a method of measuring the height of the second electrode substrate by setting a dial gauge to the front end of the measuring rod. The height of the second electrode substrate is adjusted by changing thicknesses or heights of the first and second intermediate members while measuring the height of the second electrode substrate by the method of measuring the height of the second electrode substrate.

Because an electrolytic composite electrode of the present invention has the above structure, the following functions are newly obtained without losing the functions of a conventional composite electrode.

(1) Because of the structure capable of adjusting the position of an anode surface even from the rotating cathode drum side, a function is obtained in which the interval between a cathode and an anode can be adjusted with a simple structure at a high accuracy.

(2) Because the position of the surface of an insoluble electrode can be adjusted from the rotating cathode drum side, a function is obtained in which the position of the surface of the insoluble electrode facing a cathode can be easily adjusted while measuring the distance from the rotating cathode drum.

(3) A function is obtained in which a problem on setting and adjustment of the second electrode substrate caused by deflecting the second electrode substrate (distortion of the first electrode substrate and deterioration of the second electrode substrate due to deflection of the electrode catalyst layer of the second electrode substrate) does not occur.

(4) Moreover, current can be uniformed by preventing unevenness of the current from occurring at a bolt hole for securing the second electrode substrate with the third electrode substrate.

BEST MODE FOR CARRYING OUT THE INVENTION

The present invention is described below in detail by referring to a specific embodiment of the present invention.

Figure 1:
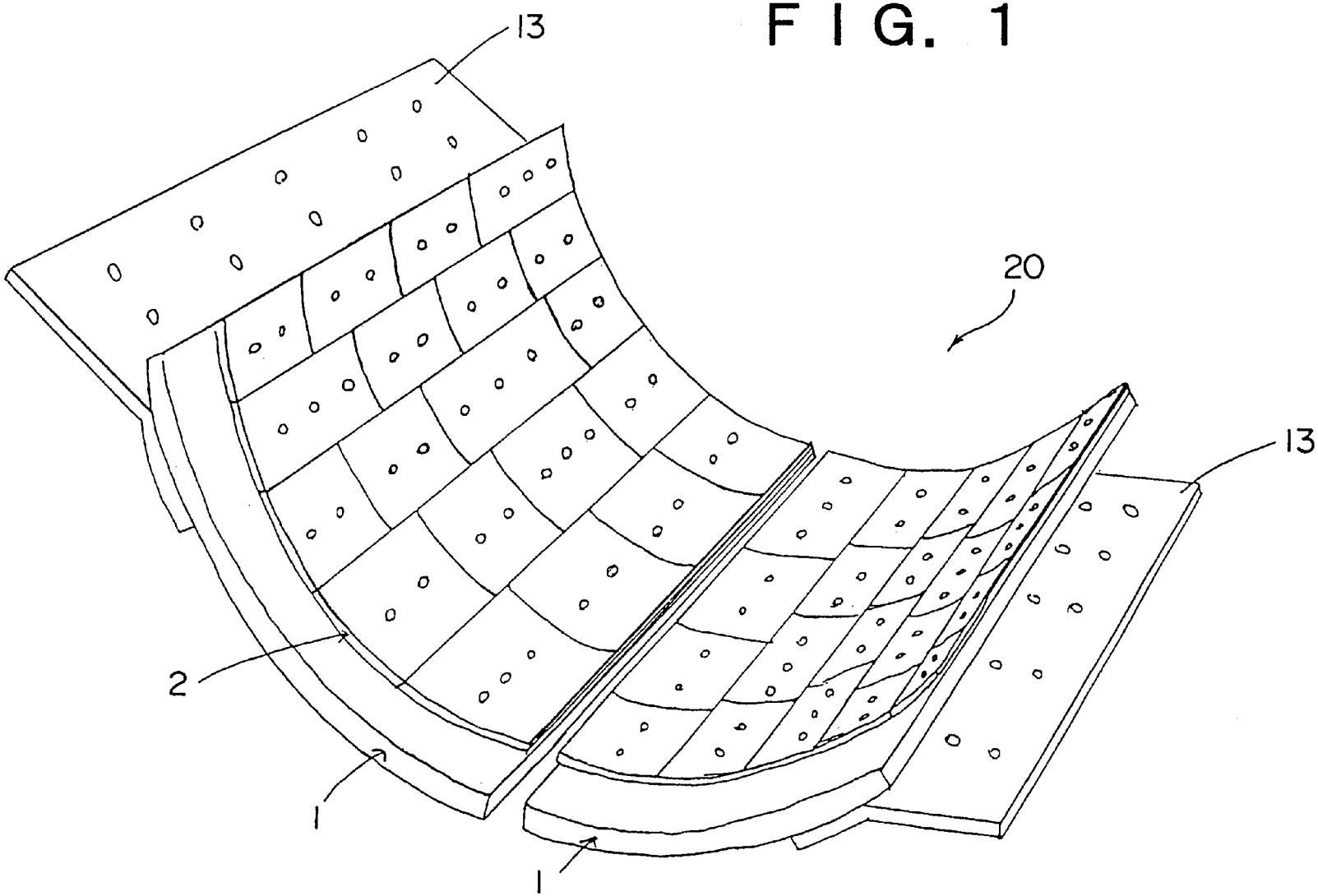
FIG. 1 is a perspective view showing a composite electrode conforming to a preferred embodiment of the present invention.
Figure 2:
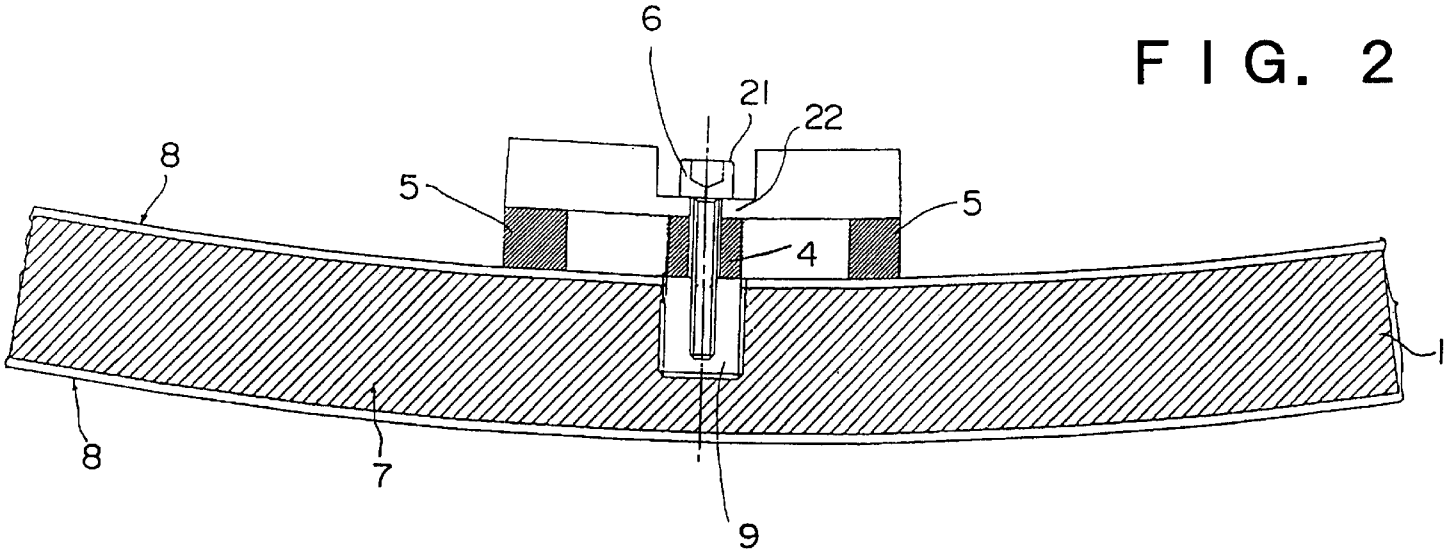
FIG. 2 is a sectional view showing a composite electrode conforming to a preferred embodiment of the present invention in the rotational direction of a cathode drum.
Figure 3:
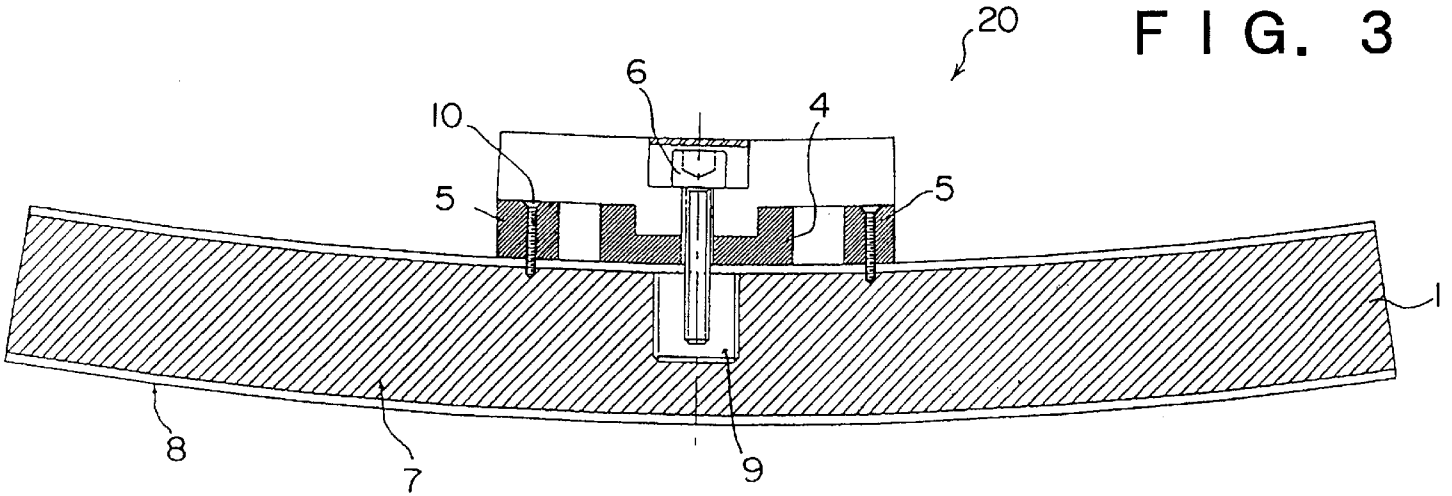
FIG. 3 is a sectional view showing a composite electrode of the present invention in the rotational direction of a cathode drum.
Figure 4:
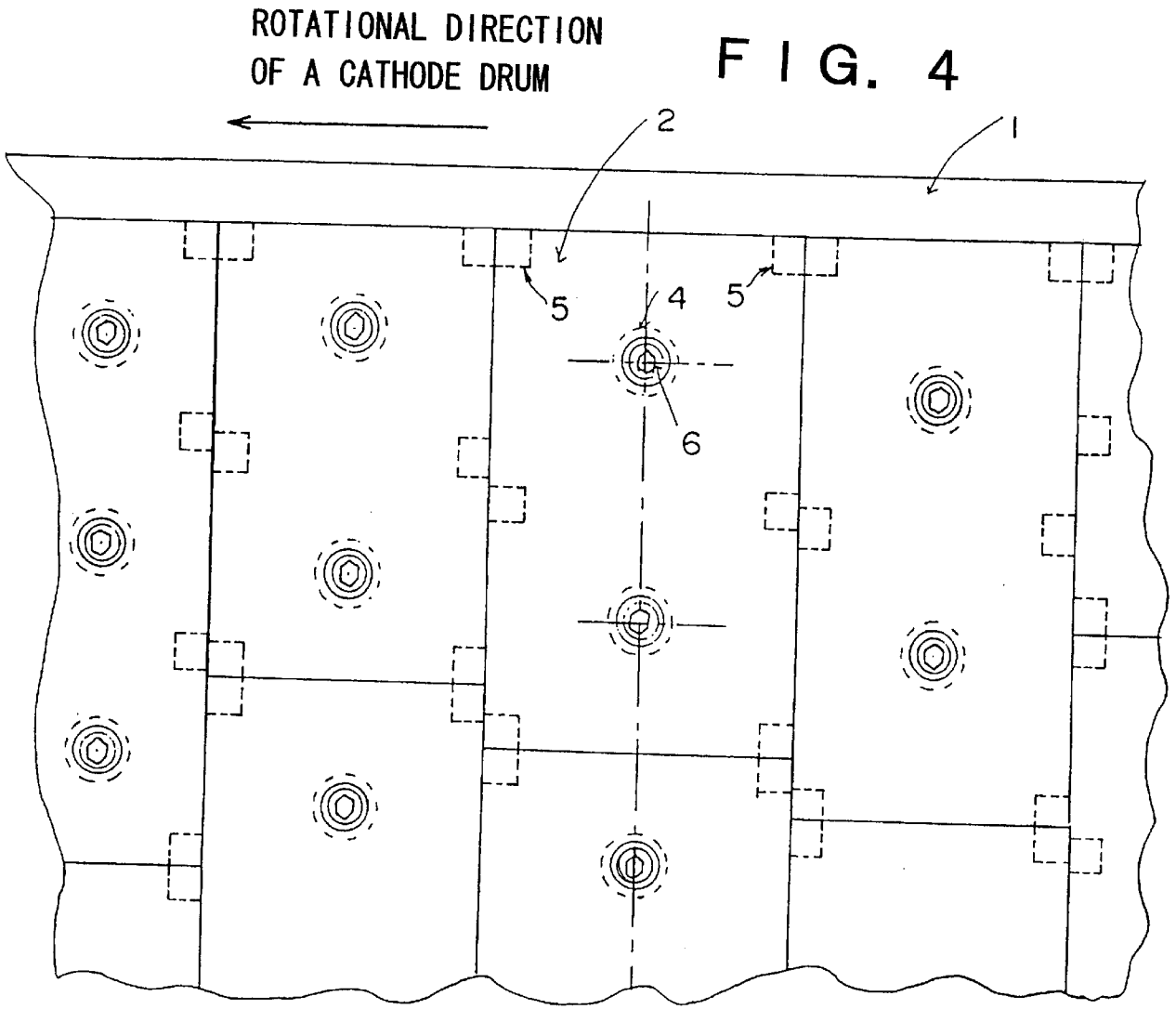
FIG. 4 is a local top view showing a composite electrode of the present invention.
Figure 5:
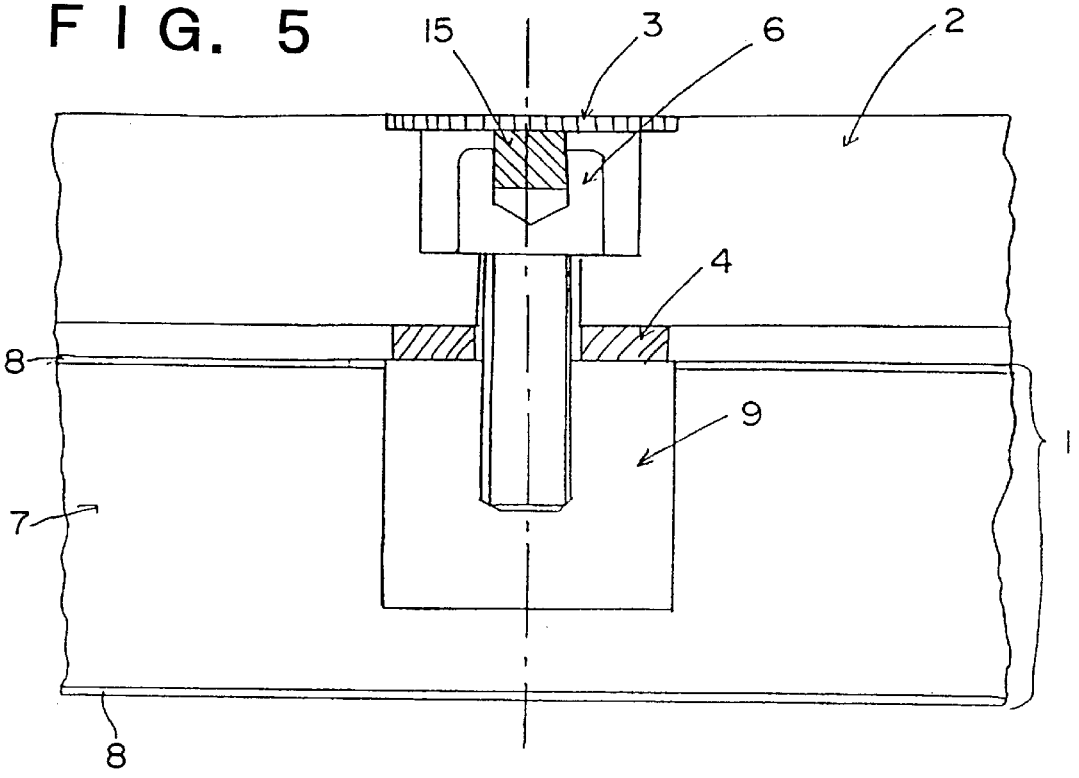
FIG. 5 is a sectional view showing a secured third electrode substrate.
Figure 6:
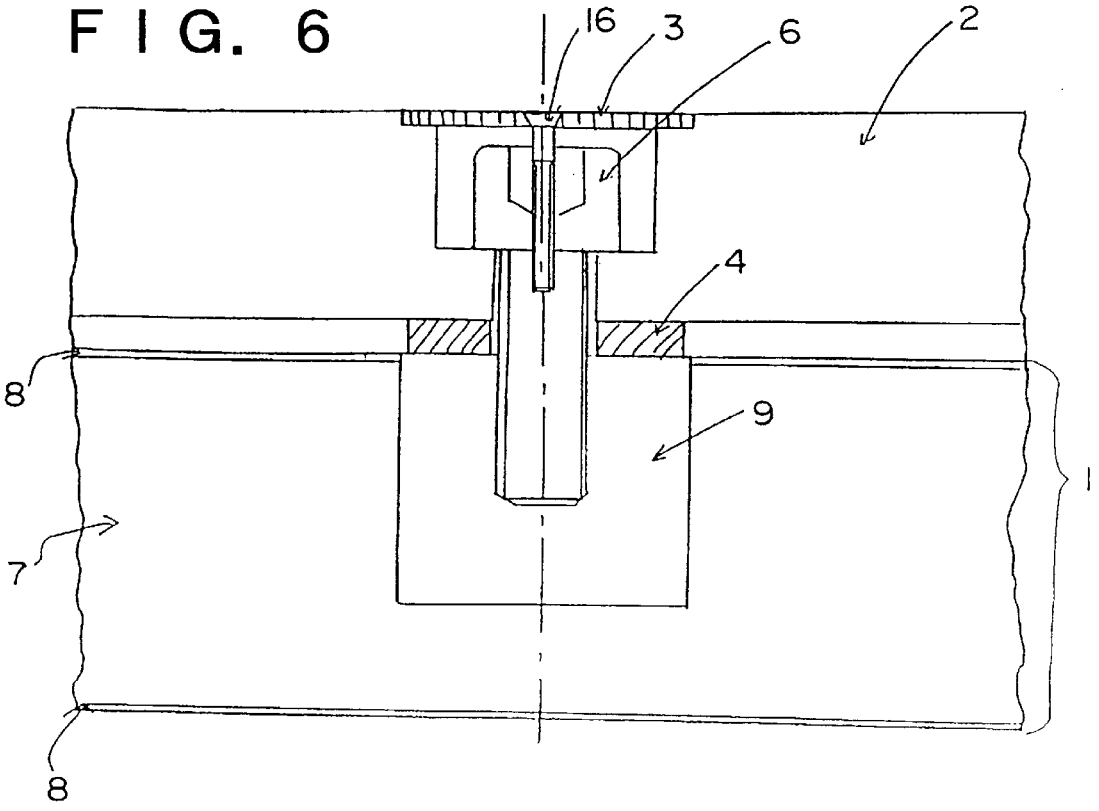
FIG. 6 is a sectional view showing a secured third electrode substrate.
Figure 7:
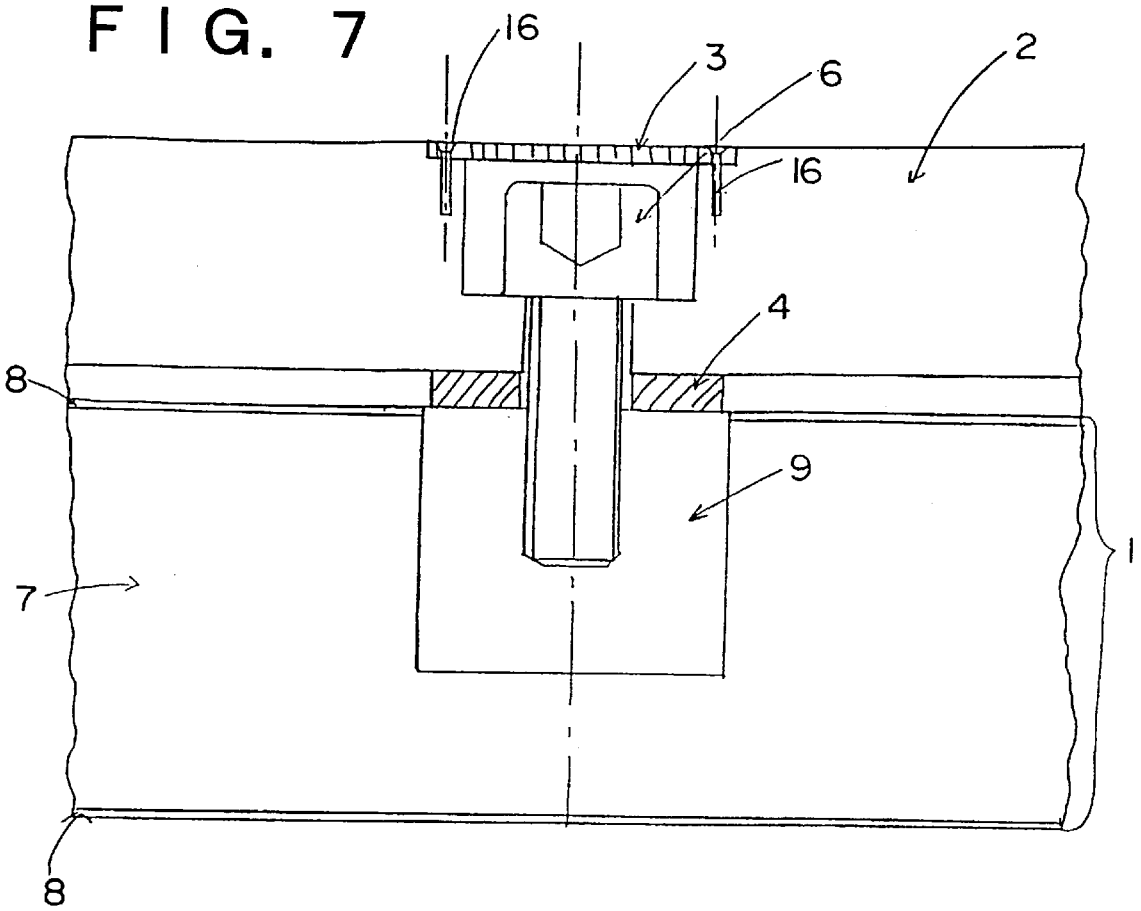
FIG. 7 is a sectional view showing a secured third electrode substrate.
Figure 8:
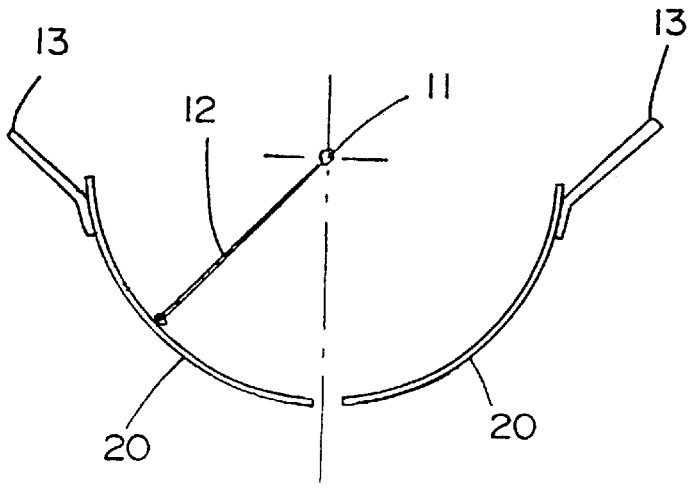
FIG. 8 is a sectional view showing measurement of the height of a second electrode substrate of the present invention viewed from the rotational direction of a cathode drum.

FIG. 1 shows a perspective view of the anode of a composite electrode 20 conforming to a preferred embodiment of the present invention. FIGS. 2 and 3 are sectional views of the composite electrode 20 in FIG. 1 in the rotational direction of a cathode drum. FIG. 4 is a top view showing a second electrode substrate 2 set to a first electrode substrate 1. FIGS. 5, 6, and 7 are sectional views showing a set third electrode substrate 3. FIG. 8 is a sectional view showing an apparatus 12 for measuring heights of the composite electrode 20, cathode-drum rotation axis 11, and second electrode substrate 2 in the rotational direction of the cathode drum.

As shown in FIGS. 1, 2, 3, and 4, the composite electrode 20 has a structure in which the second electrode substrate 2 divided into the parts is secured to the first electrode substrate 1 by a bolt 6 through a first intermediate member 4 and a second intermediate member 5. The first and second electrode substrates 1 and 2 are respectively formed with a curved almost-rectangular plate, their internal surfaces are formed into a circular arc, that is, curved at a certain curvature so as to form a part of a cylindrical side wall.

The core 7 of the first electrode substrate 1 is constituted with a clad of copper and iron and covered with a thin plate 8 made of titanium. The clad of copper and iron is manufactured by the explosive welding method and has a current-carrying characteristic and a mechanical strength. A female screw portion 9 for securing the second electrode substrate 2 of the first electrode substrate 1 with the bolt 6 is made of titanium embedded into the first electrode substrate, the gap between the thin plate 8 and the female screw portion 9 is completely sealed through welding to prevent an electrolytic solution from entering the core 7, and the surface of the female screw portion 9 (surface contacting with the first intermediate member 4) is covered with platinum to decrease the contact electrical resistance with the first intermediate member 4. A plating current is supplied to the first electrode substrate 1 from a bus bar 13. Moreover, it is enough to manufacture the first electrode substrate 1 so that the accuracy of the radius of curvature of the first electrode substrate 1 is kept in a fluctuation range of 2 mm or less for a predetermined radius. The degree of the fluctuation of 2 mm appears as the fluctuation of up to 20% of inter-electrode distance when assuming the inter-electrode distance between a cathode and an anode as 10 mm which is an average value. Therefore, the fluctuation of 20% is far from the requested fluctuation of 5% or less.

The surface of the second electrode substrate 2 facing a cathode rotational drum made from titanium is covered with an electrode catalyst mainly containing iridium oxide. Moreover, the second electrode substrate 2 is secured by the female screw portion 9 made of titanium embedded into the first electrode substrate 1 through the first intermediate member 4 by the bolt 9 from the cathode drum side, and at the same time a part of each of the both ends of the second electrode substrate 2 is supported by a second intermediate member 5. The second electrode substrate 2 can be freely set or removed, and the height of the substrate 2 can be adjusted at an accuracy of 0.01 to 0.1 mm without losing its circular-arc shape by easily changing thicknesses or heights of the first intermediate member 4 and the second intermediate member 5. As a result, it is possible to adjust the distance between cathode rotational drums to be paired with the second electrode substrate 2 at an accuracy of 0.01 to 0.1 mm. Thus, though the fluctuation of the inter-electrode distance at the accuracy of the first electrode substrate 1 is 20%, the fluctuation of the inter-electrode distance at the portion where the first intermediate member 4 and second intermediate member 5 are inserted becomes up to 1% and moreover, it is possible to easily obtain the fluctuation of 5% or less even at the portion where the first intermediate member 4 or second intermediate member 5 is not inserted.

The second intermediate member 5 is secured by holding it with the second electrode substrate 2 fastened by the bolt 6 or by using a bolt 10. The bolt 6 extends through the hole of the second electrode substrate 2 and is screwed into the female screw portion 9. As shown in FIG. 2, the hole of the second electrode substrate 2 has a shoulder portion 22 contacting with the bottom of the head 21 of the bolt 6.

The current supplied from the bus bar 13 passes through the first electrode substrate 1, the female screw portion 9, and the first intermediate member 4 and some of the current is supplied to the second electrode substrate 2 from the female screw portion 9.

FIGS. 5 to 7 show the sectional views of the set third electrode substrate 3 and the surface of the substrate 3 facing a cathode is covered with an electrode catalyst mainly containing iridium oxide similarly to the case of the second electrode substrate 2. FIG. 5 shows that a protrusion 15 to be fitted into the hexagonal hole of the hexagon socket head cap screw 6 at the back of the third electrode substrate 3, and the third electrode substrate 3 is set to the bolt 6 by driving the protrusion 15 into the hexagonal hole. Moreover, FIG. 6 shows a case of forming a hole at the center of the third electrode substrate 3 and setting the third electrode substrate 3 to the bolt 6 by a flat countersunk head screw 16 made of titanium. In this case, because it is enough that the flat countersunk head screw 16 used has a diameter of 3 to 5 mm, the uneven current distribution due to the screw 16 is kept in a very limited range and therefore, it does not influence the quality of a plated product. Moreover, FIG. 7 shows a case of setting the third electrode substrate 3 to the second electrode substrate 2 by a plurality of flat countersunk head screws 16. The setting method in FIG. 7 is effective when there is no level difference between the surface of the second electrode substrate 2 facing a cathode and the surface of the third electrode substrate 3 and a high plating-current uniformity is obtained.

The third electrode substrate 3 is set after adjustment of the height of the second electrode substrate 2 is completed and therefore, the uneven distribution of a small current nearby the bolt 6 is further decreased.

Moreover, as shown in FIG. 2, the first electrode substrate 1 and second electrode substrate 2 are separated from each other by the first intermediate member 4 and second intermediate member 5, and a void 23 is present between the substrates 1 and 2. An electrolytic solution is present in the void. Therefore, it is possible to radiate heat produce in the first electrode substrate 1 and second electrode substrate 2 in accordance with the convection of the electrolytic solution. For example, by using a pump or the like and forcibly circulating the electrolytic solution through the void, it is possible to effectively radiate the heat produced in the first electrode substrate 1 and second electrode substrate 2. However, when it is unnecessary to radiate the heat produced under operation at a low current density, it is also possible to prevent heat from radiating by inserting vinyl chloride, epoxy-based resin, silicon rubber, or air bag into the void 23.

Because the electrolytic composite electrode of the present invention is constituted as described above, the following advantages are newly obtained without losing the advantages of a conventional composite electrode.

(1) It is possible to obtain a mechanism capable of adjusting the position of the surface of an anode even from the rotating cathode drum side, adjust the interval between a cathode and an anode at a high accuracy with a simple structure, and uniform the inter-electrode distance between the cathode of a rotational drum and an anode facing the cathode at a high accuracy in the range of the conventional machining art. As a result, a large electrolytic composite electrode superior in profitability can be obtained, no plating solution leaks from a mechanism for adjusting the height of the second electrode substrate, a plating current is uniformed in accordance with easy maintenance of an anode, and plated products having uniform quality can be obtained. Moreover, because the plating current can be uniformed, the current distribution on the surface of the anode is uniformed. Thereby, the durability of the anode is improved.

(2) Because the position of the surface of an insoluble electrode can be adjusted from the rotating cathode drum side, it is possible to easily adjust the position of the surface of the insoluble electrode facing a cathode while measuring the distance of the rotating cathode drum from the rotation axis. As a result, it is possible to easily assemble and adjust an electrolytic composite electrode and moreover, the assembling accuracy is improved.

(3) A problem on setting and adjustment of a second electrode substrate due to deflection of the second electrode substrate (distortion of first electrode substrate and deterioration of second electrode substrate due to deflection of electrode catalyst layer of first electrode substrate) does not occur. As a result, even if the structure of the first electrode substrate is simplified, distortion of the entire electrolytic composite electrode produced by a second electrode substrate can be extremely decreased, the interval between a cathode and an anode can be kept constant, a plating current can be easily uniformed, and plated products having uniform quality can be obtained. Moreover, deterioration of a second electrode substrate due to deflection of an electrode catalyst is settled.

We claim:

1. An electrolytic composite electrode comprising a cathode formed from a rotated drum and an anode having a circularare inner surface facing said cathode at a certain interval and capable of keeping an electrolytic solution between said anode and said cathode; wherein said anode is provided with;

a first electrode substrate at least whose portion contacting with an electrolytic solution is made of a corrosion-resistant metal and which is provided with a plurality of female screw portions and a second electrode substrate which is so arranged that adjacent second electrode substrates do not form an overlapped portion whose one side is covered with an electrode catalyst and formed with a titanium tie plate divided on a plurality of parting faces parallel with the rotation axis of said drum and which has a plurality of holes on the center axis parallel with said parting faces, a bolt extending through said second electrode substrate and screwed to the female screw portions of said first electrode substrate to secure said second electrode substrate to said first electrode substrate, a first intermediate member which is different from said first electrode substrate and said second electrode substrate provided for the circumferential portion of said bolt between said first electrode substrate and said second electrode substrate, and a second intermediate member which is different from said first electrode substrate and said second electrode substrate provided for the vicinity of the circumference of said second electrode substrate between said first electrode substrate and said second electrode substrate.

2. The electrolytic composite electrode according to claim 1, wherein a third intermediate member provided between the central portion and the circumferential portion of said second electrode substrate is used between said first electrode substrate and said second electrode substrate.

3. The electrolytic composite electrode according claim 1, wherein at least a part of each of said first and second intermediate members is set to both or either of said first and second electrode substrates.

4. The electrolytic composite to claim 1, wherein, to close the hole of said second electrode substrate secured to said first electrode substrate by a bolt, a third electrode substrate whose one side is covered with an electrode catalyst is set so that the electrode catalyst surface of said electrode substrate is flush with that of said third electrode substrate and current can be supplied to said third electrode substrate.

5. The electrolytic composite electrode according to claim 1, wherein a parting line of said second electrode substrate extending in the rotational direction of a cathode drum and another parting line of said second electrode substrate extending in the rotational direction of said cathode drum are arranged so that they do not become a straight line.

6. A damper apparatus according to claim 1, wherein said pair of retainer plates are fixed to each other.

* * * * *